United States Patent [19]

Theurer

[11] Patent Number: 5,007,350

[45] Date of Patent: Apr. 16, 1991

[54] UNIVERSAL MOBILE TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 469,355

[22] Filed: Jan. 24, 1990

[30] Foreign Application Priority Data

Mar. 10, 1989 [EP] European Pat. Off. ..... 89890068.3

[51] Int. Cl.[5] ..... E01B 27/11

[52] U.S. Cl. ..... 104/12; 104/7.1; 104/7.2

[58] Field of Search ..... 104/7.1, 7.2, 7.3, 10, 104/12

[56] References Cited

U.S. PATENT DOCUMENTS

| | | | |
|---|---|---|---|
| 2,587,324 | 2/1952 | Hursh et al. | 104/12 |
| 3,011,454 | 12/1961 | Plasse et al. | 104/12 |
| 3,426,697 | 2/1969 | Stewart | 104/12 |
| 3,669,025 | 6/1972 | Plasser et al. | 104/12 |
| 4,445,437 | 5/1984 | Nielsen | 104/12 |
| 4,572,079 | 2/1986 | Theurer | 104/12 X |
| 4,576,095 | 3/1986 | Theurer | 104/12 |
| 4,627,360 | 12/1986 | Theurer et al. | 104/12 X |
| 4,628,822 | 12/1986 | Theurer | 104/7.2 |
| 4,643,101 | 2/1987 | Theurer | 104/7.2 |

FOREIGN PATENT DOCUMENTS

| | | |
|---|---|---|
| 1173922 | 7/1964 | Fed. Rep. of Germany . |
| 2201178 | 8/1988 | United Kingdom . |

*Primary Examiner*—Robert J. Oberleitner
*Assistant Examiner*—S. Joseph Morano
*Attorney, Agent, or Firm*—Kurt Kelman

[57] ABSTRACT

A universal mobile track leveling, lining and tamping machine useful for work in track switches and tangent track comprises four ballast tamping units mounted between the undercarriages of the machine and immediately preceding the rear undercarriage in the operating direction. The ballast tamping units are mounted for independent transverse and vertical adjustment with respect to the machine frame, a respective one of the ballast tamping units being arranged at the gage side and the field side of each rail, and each ballast tamping unit comprising a pair of vibratory tamping tools reciprocable in the direction of the track and immersible in the ballast with a respective one of the ties positioned between the tamping tools. Each unit is independently vertically adjustable on an independent vertical guide and independently transversely adjustable on at least one transverse guide. Independent power drives are connected to each ballast tamping unit for independently vertically and transversely adjusting each unit along a respective one of the vertical guides and the transverse guide. A track leveling and lining unit is mounted on the machine between the two undercarriages and immediately preceding the ballast tamping units in the operating direction, the track leveling and lining unit comprises power-driven, transversely and vertically adjustable lifting hooks and flanged lining rollers, and a leveling and lining reference system controls the track leveling and lining unit operation.

4 Claims, 3 Drawing Sheets

Fig. 5
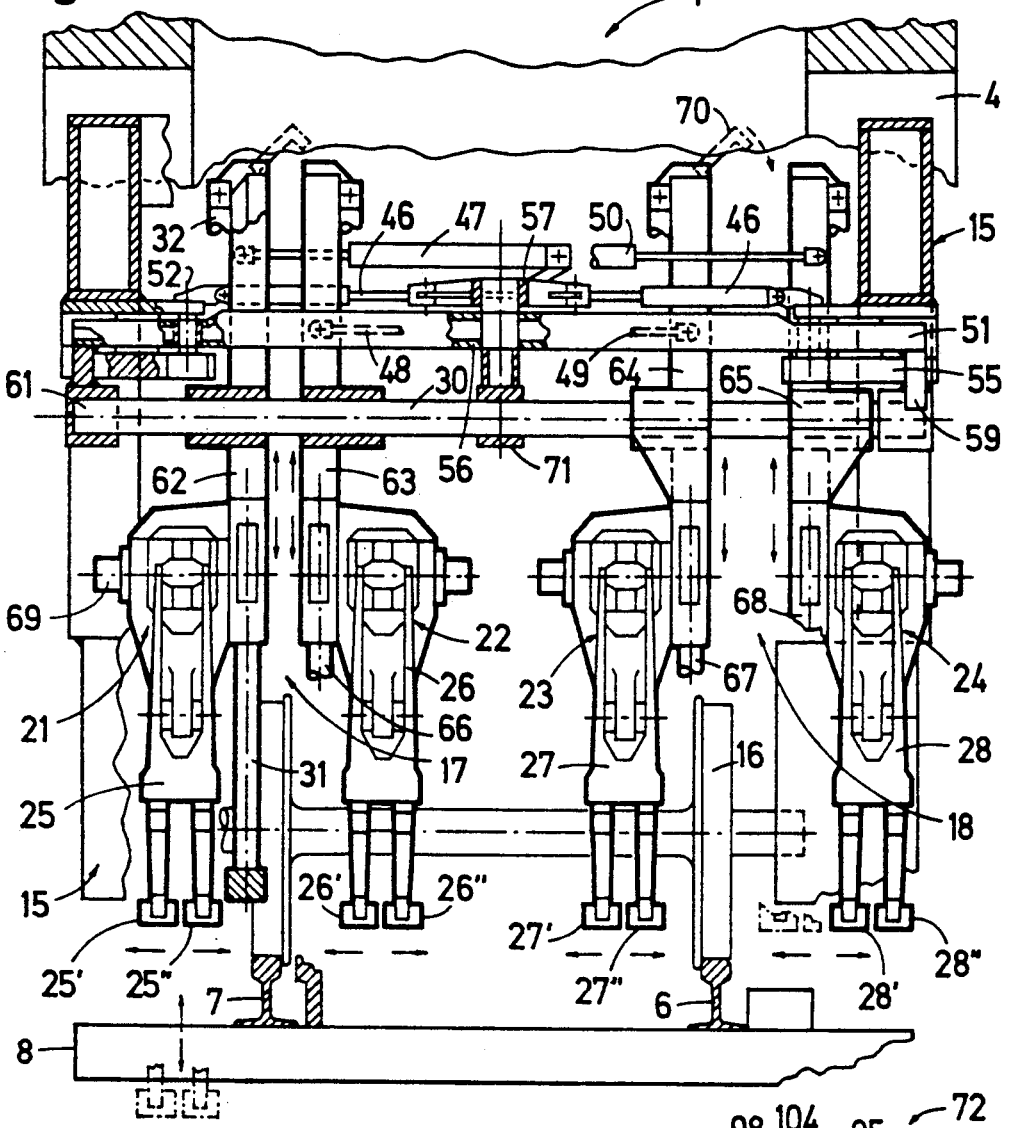
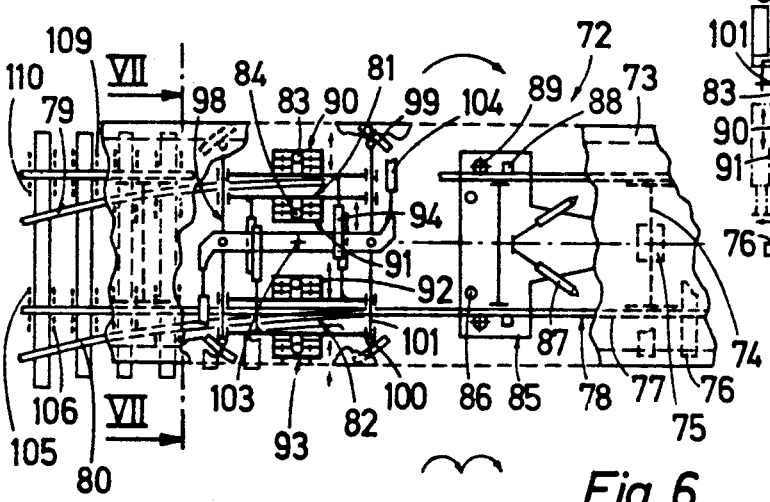
Fig. 6
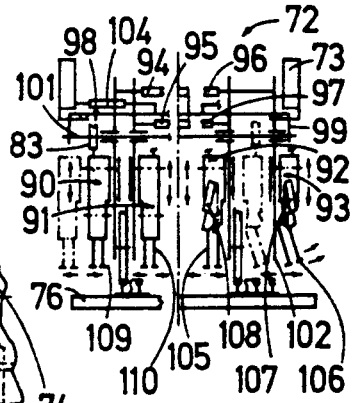
Fig. 7

UNIVERSAL MOBILE TRACK LEVELING, LINING AND TAMPING MACHINE

BACKGROUND OF THE INVENTION (1) Field of the Invention

The present invention relates to a mobile track leveling, lining and tamping machine useful for work in track switches and tangent track, the track comprising two rails fastened to ties supported on ballast and each rail having a gage side and a field side, which comprises a machine frame mounted for mobility along the track in an operating direction and carrying drive, brake, operating energy source and operating control means, and two widely spaced undercarriages supporting the machine on the track, including a rear undercarriage in the operating direction. The machine has ballast tamping units mounted between the undercarriages and immediately preceding the rear undercarriage in the operating direction, the ballast tamping units being mounted for independent transverse and vertical adjustment with respect to the machine frame, a respective one of the ballast tamping units being arranged at the gage side and the field side of each rail, and each ballast tamping unit comprising a pair of vibratory tamping tools reciprocable in the direction of the track and immersible in the ballast with a respective one of the ties positioned between the tamping tools. A track leveling and lining unit is mounted on the machine between the two undercarriages and immediately preceding the ballast tamping units in the operating direction, the track leveling and lining unit comprising power-driven, transversely and vertically adjustable lifting hooks and flanged lining rollers operated by a leveling and lining reference control system.

(2) Description of the Prior Art

U.S. Pat. No. 4,627,360, dated Dec. 9, 1986, discloses such a compact track leveling, lining and tamping machine. Compact machines have been very successfully used because the coordinated arrangement of the ballast tamping units and the track leveling and lining unit spaced therefrom at a constant distance and arranged between two widely spaced undercarriages supporting the machine on the track results in a much more accurate track position correction than the previously used cantilevered construction, the relatively wide spacing of the undercarriages also producing a much less pronounced bending of the rails during the leveling and/or lining operation therebetween so that the rails are not subjected to unacceptable flexing forces. The machine disclosed in this patent comprises a machine frame carrying drive, brake, operating energy source and operating control means and the machine frame is supported for mobility along the track in an operating direction by two wide spaced undercarriages. Two ballast tamping units are mounted on vertical and transverse guides between the undercarriages for independent transverse and vertical adjustment with respect to the machine frame, and each unit comprises two pairs of vibratory tamping tools reciprocable in the direction of the track and immersible in the ballast with a respective tie positioned between the tamping tools, a respective pair being arranged at the gage side and the field side of each rail. A track leveling and lining unit is also mounted between the two undercarriages and is vertically and laterally adjustable by lifting and lining drives operated under the control of a leveling and lining reference system. This unit carries a power-driven, transversely and vertically adjustable lifting hook engageable with each rail and a pair of flanged lining rollers which may be pressed against the gage side of a respective rail by the lining drive. To enable the tamping operation to adjust to obstacles encountered along the track, particularly in switches, the ballast tamping units have tamping picks which may be laterally pivoted. This machine is adapted for universal operation in tangent track and track switches. It is furthermore adapted for continuous operation because the ballast tamping units as well as the track leveling and lining unit are mounted on a tool-carrying frame which is longitudinally displaceable with respect to the machine frame in the direction of the track, and a power drive longitudinally displaces the tool-carrying frame with respect to the continuously advancing machine frame so that the tool-carrying frame is held in a fixed position during each tamping operation. This non-stop operating machine type has revolutionized the track maintenance and rehabilitation technology since the separation of the machine frame from the tool-carrying frame has made it possible to permit the continuous advance of the heavy machine during the cyclic tamping operations only 20–30% of the entire machine mass being accelerated and decelerated between the tamping cycles while the vibrations resulting from the intermittent tamping are kept from the operating personnel riding on the continuously and evenly advancing heavy machine frame. This considerably enhances the comfort of the operators and, in addition, enables the machine to be used effectively even in difficult switch areas because the undercarriage supporting the tool-carrying frame on the track may be moved laterally onto the branch track as it branches off the main track at the beginning of the switch while the main frame remains on the main track.

U.S. Pat. No. 4,576,095, dated Mar. 18, 1986, also discloses a compact ballast tamping machine comprising two ballast tamping units respectively associated with a respective rail of a railroad track and mounted for independent, power-driven transverse adjustment. Each unit has two pairs of vibratory tamping tools reciprocable in the direction of the track and immersible in the ballast with a respective tie positioned between the tamping tools, a respective pair of each unit being arranged at the field side and the gage side of each rail, and each tamping tool has a double tamping pick connected to a power drive for independently vertically adjusting each double tamping pick. This enables each immersible tamping tool to be independently vertically adjusted to avoid an obstacle at either side of each rail.

U.S. Pat. No. 4,445,437, dated May 1, 1984, British patent application No. 2,201,178, published Aug. 24, 1988, and U.S. Pat. No. 3,426,697, dated Feb. 11, 1969, disclose switch tampers of the older, i.e. cantilevered, construction wherein the ballast tamping units are mounted on a projecting portion of the machine frame forwardly of the front wheels. They belong to a class of smaller tampers used mostly for spot tamping, and they are not equipped for track leveling and/or lining. Such machines cannot be used for accurate track position correction, including fixing the track in the corrected position.

The track tamper of U.S. Pat. No. 4,445,437 is equipped with two independent tamping units arranged on opposite sides of each track rail and each unit is mounted on a carrier frame for independent vertical and transverse adjustment, U.S. Pat. No. 2,587,324, dated Feb. 26, 1952 being acknowledged in the patent as prior art to show two tamping units arranged above each rail an transversely movable to permit tamping by displacement of the tamping tools with different operating strokes at the two sides of each rail. The tamping units are also vertically adjustable. In the illustrated embodiment, the four tamping units of U.S. Pat. No. 4,445,437 are connected to the machine frame by a lever system so that the transverse adjustment of each tamping unit simultaneously causes it to be pivoted about an axis extending in the longitudinal direction of the machine. The structure is rather cumbersome and requires considerable forces for pivoting the heavy tamping units.

In the tamping machine of British patent application No. 2,201,178, each of the four tamping units is individually vertically adjustable by its own power drive, two of the units being associated with each rail and each tamping unit having its own drive for transversely adjusting the unit on a guide frame. The machine is not equipped for track correction but in this class of cantilevered tampers it was conventional to mount track lifting and leveling tools, if any, in the projecting portion of the machine frame. With these outdated track leveling, lining and tamping machines, the track lifting strokes were quite limited and the track correction was relatively inaccurate. However, the requirements for track correction accuracy are particularly high in track switches, which are expensive, difficult to grip and quite heavy to lift and shift, and these requirements can be commercially met only with the above-described compact machines wherein the operating tools are mounted between widely spaced undercarriages.

The switch tamper of U.S. Pat. No. 3,426,697 has two vertically adjustable tamping units respectively associated with each track rail and independently transversely adjustable. These tamping units are mounted on a carrier frame which is cantilevered to the forward end of the machine frame and is pivotal by a power drive about a vertical axis and they are transversely displaceable along a transverse guide on the carrier frame so that the tamping tools may be adjusted to the varying spacing between the rails in track switches. This tamping unit arrangement is structurally complicated and does not enable the tamping tools to be accurately centered with respect to the tie to be tamped since the vertical pivoting axis is at a relatively great distance from the center of the transverse guide. This means that the tamping picks do not come to extend parallel to obliquely positioned ties in the switch so that proper tamping of the ballast under the ties is impossible.

U.S. Pat. No. 3,669,025, dated June 13, 1972, also deals with the same type of track tamper, and FIG. 17 of this patent illustrates ballast tamping units operable in switches and comprising hydraulically vibrated pairs of reciprocable tamping tools arranged at the field and gage sides of each rail. Each tamping unit may be vertically adjusted and the units or their pairs of tamping tools may also be independently transversely adjusted, as is more fully explained in column 4 of the patent in connection with the description of FIGS. 8–10 and 13. This enables the machine to operate without interruption or delays as the tamping tools encounter guide rails, frogs and the like. The spacing between the tamping units at each side of the rail may be adjusted since these units are transversely displaceably mounted on guide rails affixed, if desired, to a common carrier frame, as appears particularly from FIG. 13 showing four such transversely adjacent and mutually independently adjustable ballast tamping units arranged at the field and gage sides of each track rail. The tamping tools on one side of the rail or on both rail sides may form a structural unit with the carrier frame on which they are mounted, and this structural unit may be pivoted about a vertical axis extending in the plane of symmetry of this unit so that the tamping tools may be centered with respect to an obliquely positioned tie, as shown in FIGS. 12 and 17. While this makes it possible to compensate for a slightly oblique position of a tie and to adapt the positioning of the tamping tools to the tie position, the tamping picks will not extend parallel to the oblique tie.

SUMMARY OF THE INVENTION

It is the primary object of this invention to provide a universal mobile track leveling, lining and tamping machine of the compact type which is useful for work in track switches and tangent track, and which is effective even in the most difficult switch areas so that such switch areas may not only by effectively tamped but may be simultaneously fixed in an accurate desired track position.

This and other objects are accomplished according to the invention with a universal mobile track leveling, lining and tamping machine which comprises a machine frame mounted for mobility along the track in an operating direction and carrying drive, brake, operating energy source and operating control means, and two widely spaced undercarriages supporting the machine on the track, including a rear undercarriage in the operating direction. Four ballast tamping units are mounted between the undercarriages and immediately preceding the rear undercarriage in the operating direction, the ballast tamping units being mounted for independent transverse and vertical adjustment with respect to the machine frame, a respective one of the ballast tamping units being arranged at the gage side and the field side of each rail, and each ballast tamping unit comprising a pair of vibratory tamping tools reciprocable in the direction of the track and immersible in the ballast with a respective one of the ties positioned between the tamping tools. The machine further comprises an independent vertical guide means for independently vertically adjusting each ballast tamping unit, at least one transverse guide means for independently transversely adjusting the ballast tamping units, independent power drive means connected to each ballast tamping unit for independently vertically and transversely adjusting each unit along a respective one of the vertical guide means and the transverse guide means, a track leveling and lining unit mounted on the machine between the two undercarriages and immediately preceding the ballast tamping units in the operating direction, the track leveling and lining unit comprising power-driven, transversely and vertically adjustable lifting hooks and flanged lining rollers, and a leveling and lining reference system controlling the track leveling and lining unit operation.

A machine combining all of these structural features constitutes a modern, efficient compact track leveling, lining and tamping machine with specially designed ballast tamping units mounted immediately succeeding the track leveling and lining unit for lifting and lining the track without hindrance and without subjecting the track rails to undue flexing forces. The independent vertical and transverse adjustment of the four tamping units rapidly adjusts the tamping picks immersible in the ballast to all encountered track obstacles, particularly in switches where work is done at the branch and/or adjacent track connected to the main track by extra-long ties, so that these very expensive track sections may be repositioned and tamped, too. The machine can be used without restriction and without requiring any retrofitting for maintenance and rehabilitation work in tangent track and in switches.

BRIEF DESCRIPTION OF THE DRAWING

The above and other objects, advantages and features of the present invention will become more apparent from the following detailed description of certain now preferred embodiments thereof, taken in conjunction with the accompanying, partly schematic drawing wherein

FIG. 5 is a sectional view along line V—V in FIG. 3;

FIG. 6 is a somewhat diagrammatic, fragmentary view illustrating a compact track leveling, lining and tamping machine according to another embodiment of this invention, with an intermittently advancing machine frame whereon a carrier frame for four ballast tamping units is mounted; and FIG. 7 is a sectional view along line VII—VII in FIG. 6, the tamping unit at the right having laterally pivotal tamping picks.

DESCRIPTION OF THE PREFERRED EMBODIMENTS

Figure 1:
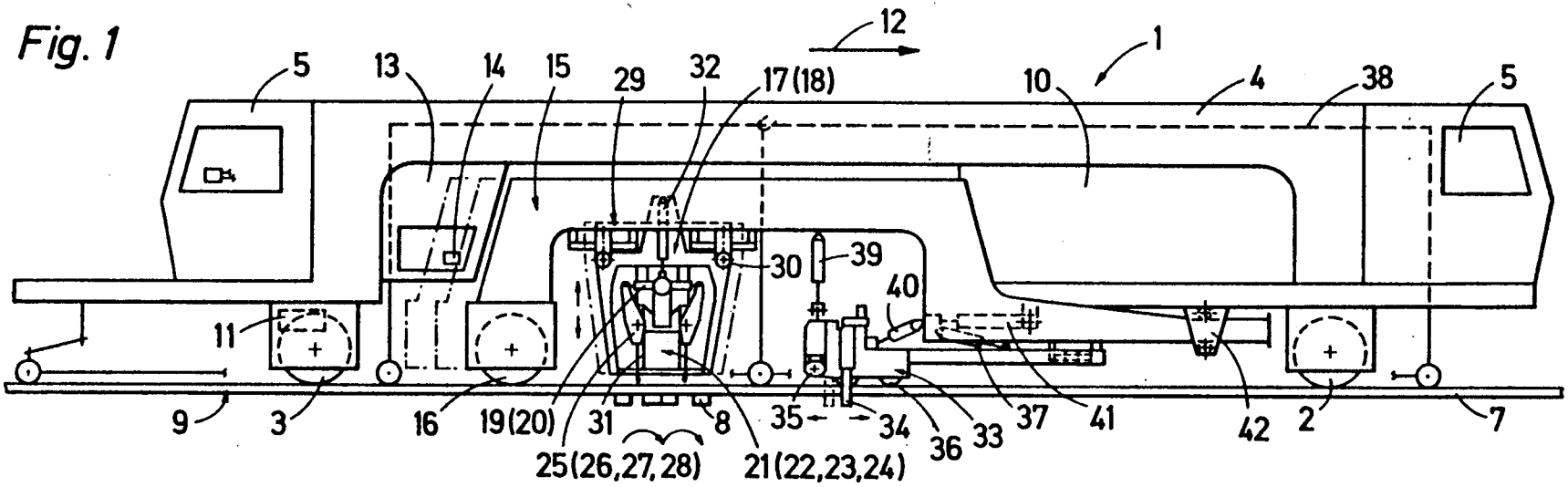
FIG. 1 is a side elevational view of one embodiment of a universal mobile track leveling, lining and tamping machine according to this invention, with a longitudinally displaceable tool-carrying frame for non-stop operation of the machine and a rotatable carrier frame mounting four ballast tamping units on the tool-carrying frame.
Figure 2:
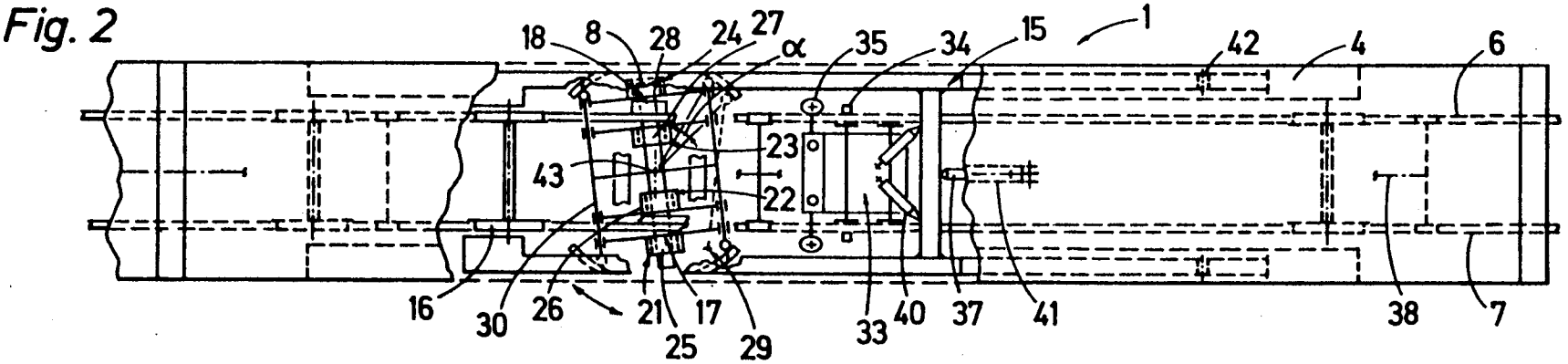
FIG. 2 is a somewhat diagrammatic top view of the machine of FIG. 1, showing the carrier frame rotated into a position wherein the tamping tools extend parallel to an obliquely positioned tie.

Referring now to the drawing and first to FIGS. 1 and 2, the illustrated universal mobile track leveling, lining and tamping machine 1 is useful for work in track switches and tangent track. Track 9 comprises two rails 6, 7 fastened to ties 8 supported on ballast and each rail has a gage side and a field side. Machine 1 comprises machine frame 4 mounted for mobility along track 9 in an operating direction indicated by arrow 12 and carrying drive means 11, brake means, operating energy source means 10 and operating control means 14. Two widely spaced undercarriages 2, 3 support machine frame 4 on track 9, including rear undercarriage 3 in the operating direction, and driver's cabs 5, 5 are mounted at each end of the machine frame. In the illustrated embodiment, all power drives for driving the machine and its operating tools are hydraulically operated and, therefore, operating energy source means 10 comprises an hydraulic fluid sump and hydraulic fluid conduits connecting the drives to the sump. Operator's cab 13 is mounted on machine frame 4 in front of rear undercarriage 3 and operating control means 14 comprises a control panel in cab 13 for central control of the machine operation.

The continuously operating machine shown in FIGS. 1 to 5 comprises tool-carrying frame 15 supporting four ballast tamping units 21, 22, 23, 24 between undercarriages 2, 3 and immediately preceding rear undercarriage 16 in the operating direction, this rear undercarriage supporting one end of tool-carrying frame 15 on track 9 while an opposite end of the tool-carrying frame is longitudinally displaceably supported on machine frame 4 for longitudinal displacement of tool-carrying frame 15 with respect to the machine frame in the direction of the track while the machine frame is driven continuously. For this purpose, hydraulic drive 41 links the tool-carrying frame to the machine frame and enables the relative cyclic displacement of the tool-carrying frame with respect to the machine frame.

This arrangement enables the machine to advance continuously along a tangent track during the cyclic tamping operations at the successive ties, affording highest comfort to the operating personnel riding on the machine frame advancing continuously along the tangent track and the beginning and end of the switch without being subjected to the vibrations and intermittent decelerations and accelerations of the tool-carrying frame. At the same time, the tool-carrying frame can be locked to the machine frame for intermittent movement therewith for tamping in tangent track areas and switches where obstacles may be encountered. Therefore, this universal track rehabilitation machine can be used to tamp ties without hindrance in track sections where it would be impossible to immerse all tamping units by simply and rapidly vertically and/or transversely adjusting any tamping unit which would encounter an obstacle so that its tamping pick may be immersed in the ballast next to the obstacle or be raised out of the way entirely if there is no room for its immersion.

Figure 3:
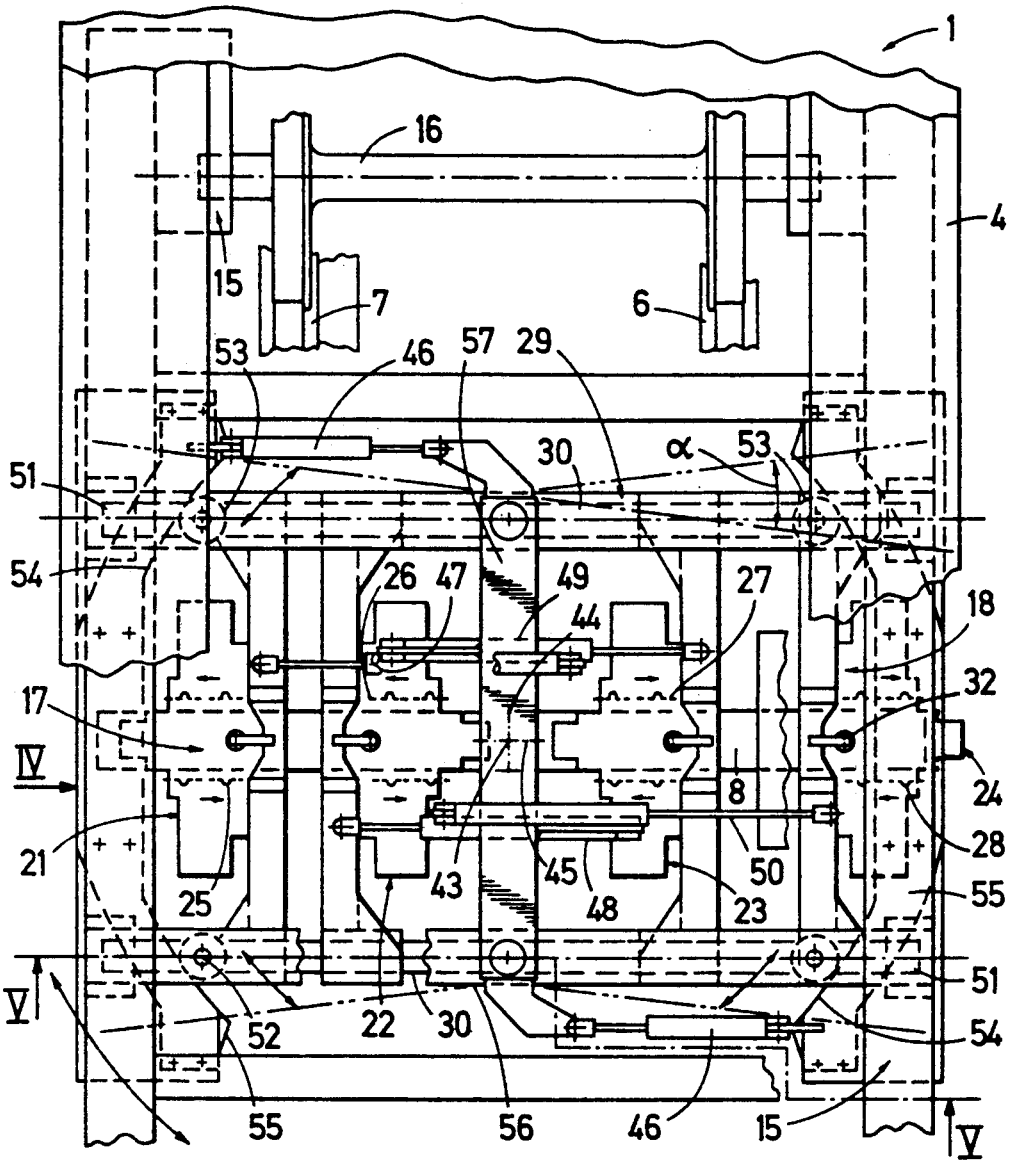
FIG. 3 is an enlarged fragmentary top view showing the carrier frame and the tamping tool units in detail.
Figure 4:
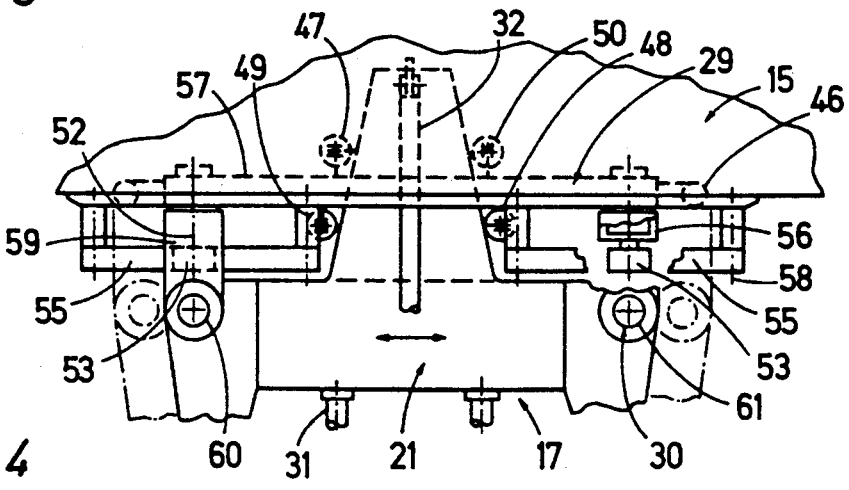
FIG. 4 is a fragmentary side view taken in the direction of arrow IV in FIG. 3.

As illustrated in detail in FIGS. 3 to 5, tamping head 17 is associated with track rail 7 and tamping head 18 is associated with track rail 6, tamping head 17 comprising ballast tamping units 21, 22 and tamping head 18 comprising ballast tamping units 23, 24, each unit being mounted for independent transverse and vertical adjustment with respect to machine frame 4, and a respective ballast tamping unit being arranged at the gage side and the field side of each rail 6, 7. Each ballast tamping unit comprises a pair 25, 26, 27, 28 of vibratory tamping tools reciprocable in the direction of track 9 by hydraulic drives 19, 20 and immersible in the ballast with a respective tie 8 positioned between the tamping tools. Each ballast tamping unit is independently vertically adjustable on respective vertical guide 31, 66, 67, 68 by an independent hydraulic drive 32 connected to each unit, and independently transversely adjustable on transverse guide means 30 comprised of two guide beams 60, 61 (see FIG. 4) by independent hydraulic drive 47, 48, 49, 50 connected to each unit. The two transverse guide beams constitute a common transverse guide for the four ballast tamping units.

Track leveling and lining unit 33 is mounted on tool-carrying frame 15 between the two undercarriages 2 and 16 and immediately preceding the ballast tamping units in the operating direction, and this unit comprises power-driven, transversely and vertically adjustable lifting hooks 34 and flanged lining rollers 36 as well as flanged lifting rollers 35. The lifting hooks and/or rollers are selectively adjusted into engagement with the track rails for lifting the track during leveling and the lining rollers, which also serve to support unit 33 on the track, are selectively adjusted into engagement with the gage side of one of the rails, depending on the transverse direction into which the track is to be shifted for alignment. The track leveling and lining unit is longitudinally displaceably linked to tool-carrying frame 15 by hydraulic drive 37 so that lifting hook 34 can always be lowered between two adjacent ties to grip the foot of the rail during the intermittent tamping operations. Track leveling and lining units 33 is also linked to tool-carrying frame 15 by hydraulic lifting and lining drives 39, 40 whose operations are controlled by leveling and lining reference system 38. Rear undercarriage 16 supports and guides the tool-carrying frame on track 9 and this tool-carrying frame has a forwardly projecting center pole longitudinally displaceably carried on machine frame 4 in longitudinal guide bearing 42.

As best shown in FIG. 3, tamping heads 17, 18 comprising ballast tamping units 21 to 24 are mounted on carrier frame 29 which is pivotal about substantially vertical axis 43 constituted by a line of intersection between vertical plane of symmetry 44 extending in the longitudinal direction of machine 1 and vertical plane of symmetry 45 extending transversely thereto and passing between pairs 25 to 28 of tamping tools of the four ballast tamping units. Power drives 46 enable the carrier frame to be pivoted about the vertical axis in either direction in a plane extending substantially parallel to the track plane, as indicated by a double-headed arrow. This common carrier frame for the tamping heads has the advantage that all four ballast tamping units may be repositioned in unison to be centered with respect to an obliquely positioned tie 8 (as shown in FIG. 2), in addition to the independent transverse adjustability of each ballast tamping unit. In this way, obliquely extending ties encountered along a tangent track or a switch may be readily and effectively tamped in the same manner as ties extending perpendicularly to the rails. This universal machine can accordingly be used with highest accuracy and practically at every point of even the most difficult switches, including at the long ties encountered in switches, maintaining the highest tamping quality at all points because the tamping picks will always extend parallel to the tie edges when they are immersed in the ballast.

As shown in FIG. 2, ballast tamping units 22 and 24 have been transversely displaced from their normal position so that they may be operated despite the presence of a guide rail adjacent rail 7 of main track 9 and of a switch box of a control device adjacent main track rail 6. After oblique tie 8 has been tamped to fix track 9 in the correct position obtained by operation of track leveling and lining unit 33, carrier frame 29 is returned to its normal position wherein transverse guide means 30 extends perpendicularly to the center line of machine 1 so that the succeeding tie may be properly tamped without interruption of the track work.

As shown in FIG. 3, guide supports 51 carry carrier frame 29 in guide bearings 55 on the machine at opposite lateral ends of the carrier frame, the guide bearings being mounted on tool-carrying frame 15 in the illustrated embodiment. The transverse guide means 30 consisting of two parallel guide beams is connected to the carrier frame and transverse adjustment hydraulic drives 47 to 50 connect ballast tamping units 21 to 24 to carrier frame 29. The illustrated carrier frame is rectangular and extends over the entire width of the tool-carrying frame and machine frame, a respective guide support 51 at each corner of the carrier frame being journaled in guide bearings 55 so that carrier frame 29 may be pivoted about vertical axis 43 through an angle $\alpha$ of at least 10° to 20°, preferably about 16°. To facilitate the turning of the carrier frame, four guide rollers 53, which are rotatable about a respective vertical axis 52, are mounted on carrier frame 29 adjacent guide supports 51 for centering the carrier frame along arcuate guide faces 54 of guide bearings 55 on tool-carrying frame 15. The transverse guide beams 60, 61 are affixed to two parallel cross beams 56 which are braced by connecting center beam 57 and carrier frame pivoting drives 46 are linked to the center beam.

As can be seen in FIG. 4, guide bearings 55 supporting carrier frame 29 are U-shaped and screwed by bolts 58 to the underside of tool-carrying frame 15. The two cross beams 56 are supported at their ends, which are constituted by guide supports 51, on the guide bearings, guide rollers 53 being affixed to the undersides of the cross beams and engaging arcuate guide faces 54 of guide bearings 55. This support of the ballast tamping units on a pivotal carrier frame provides a very simple and robust support structure and enables the independently adjustable units to be retrofitted readily on the machine frames or tool-carrying frames of existing machines. The described and illustrated guidance of the carrier frame during pivoting will securely absorb the impacts of the tamping picks immersed into the ballast as well as their vibrations and makes it possible rapidly and accurately to turn all four ballast tamping units 21 to 24 about vertical axis 43 by an angle conforming to the angle of an obliquely extending tie. Since the ends of guide supports 51 are connected by vertical coupling elements 59 with transverse guide means 30, the four ballast tamping units 21 to 24 may be readily transversely adjusted by drives 47 to 50, independently of the turning movement of carrier frame 29. The left and right end positions of tamping head 17 after a maximal turning of the carrier frame about axis 43 are indicated in chain-dotted lines in FIG. 4.

As shown in FIG. 5, each ballast tamping unit 21 to 24 comprises a frame 62, 63, 64, 65 whereon the pair of tamping tools of the ballast tamping unit is mounted. Each ballast tamping unit frame is independently vertically adjustably mounted on respective vertical guide 31, 66, 67, 68. Transverse guide means 30 is comprised of two parallel guide beams 60, 61 at opposite ends of the ballast tamping unit frames 62 to 65 and the frames are transversely adjustably mounted on the guide beams. Each power drive 47 to 50 for independently transversely adjusting each unit is connected to a respective ballast tamping unit frame and a respective end of longitudinal carrier beam 57. Guide beams 60, 61 are centrally braced by support 71 affixed to carrier frame 29. This arrangement makes it possible accurately and rapidly to adjust the ballast tamping units transversely even if the displacement path is relatively long to make work in all areas of a switch possible.

Each ballast tamping unit comprises its own vibrating drive 69 for vibrating the tamping tools 25, 26 and 27, 28 and each vibrating drive projects laterally from a respective longitudinal side of the ballast tamping unit frame in the direction of the field side and the gage side of the associated rail 6, 7, respectively. This arrangement of the vibrating drives enables the operator to view the tamping picks clearly in every transverse position of the ballast tamping units so that he may properly control the centering of the tamping picks with respect to an oblique tie. The enable the tamping tool pairs 25, 26 and 27, 28 of each tamping head 17, 18 to be transversely adjusted in unison, their frames 62, 63 and 64, 65 may be connected to each other by a mechanical coupling 70 (indicated schematically in broken lines in FIG. 5). Each tamping tool has a double tamping pick 25', 25''; 26', 26''; 27', 27''and 28', 28''.

When a track obstacles is encountered during the tamping operation, such as a guide rail next to rail 7 or a switch box next to rail 6, as shown in FIG. 5, the ballast tamping unit 22, 24 above the obstacle is transversely adjusted independently of adjacent unit 21, 23 by operating drives 48, 50 until their double picks 26', 26'' and 28', 28'' have been moved to a position laterally adjacent the obstacle and may, therefore, be immersed in the ballast next to the obstacle. If, in addition, the tie to be tamped is positioned obliquely, i.e. does not extend perpendicularly to the track rails, drives 46 are operated to turn carrier frame 29 with its four ballast tamping units until the tamping picks extend parallel to the oblique tie.

FIGS. 6 and 7 schematically illustrate compact track leveling, lining and tamping machine 72 comprising elongated machine frame 73 supported on track 78 comprised of rails 77 fastened to ties 76, widely spaced undercarriages 74 supporting the machine frame for mobility on the track for intermittent advancement therealong from tamping station to tamping station, as indicated by short arcuate arrows. To illustrate the work of this machine in a switch, FIG. 6 shows branch track 79 with frogs 80. Respective tamping heads 81, 82 with vertical adjustment drives 83, 84 and track leveling and lining unit 85 are arranged on machine frame 73 between the widely spaced undercarriages. Lifting and lining drives 86, 87 link unit 85 to the machine frame, and this unit comprises vertically and laterally adjustable lifting hooks 88, lifting rollers 89 and a pair of flanged lining rollers. Similarly to the previously described embodiment, tamping heads 81, 82 are comprised of four independently vertically and transversely adjustable ballast tamping units 90 to 93, each unit having a pair of reciprocable and vibratory tamping tools. Each ballast tamping unit has its own and independently operable transverse adjustment drive 94 to 97 connecting it to a carrier frame 98 for all ballast tamping units. The opposite ends of this carrier frame are supported in arcuate guide bearings 99 affixed to machine frame 73. Rotatable guide rollers 100 are mounted on the carrier frame and are guided in the guide bearings to enable the carrier frame to be turned about vertical axis 103 by drives 104 connected, on the one hand, to machine frame 73 and, on the other hand, with an elongated central beam of carrier frame 98 extending in the longitudinal direction of the machine frame, all in a manner similar to that hereinabove described in connection with the embodiment of FIGS. 1 to 5. Also similarly thereto, each ballast tamping unit 90 to 93 has its own frame 102 whereon the pairs of tamping tools of each unit are mounted, and these frames 102 are transversely adjustably mounted on two transverse parallel guide beams 101. Each tamping tool has double tamping picks 105, 106, 109, 110. As shown in FIG. 7, the tamping tools of tamping head 82, i.e. ballast tamping units 92 and 93, have double picks 105, 106 pivotal about an axis extending in the longitudinal direction of machine 72, and independent hydraulic drive 107, 108 is connected to each tamping pick for pivoting about this axis. This arrangement gives an additional possibility to assure complete tamping of a switch, particularly at a long tie. Thus, even a very small space between the main track and the branch track will enable a single double pick to be immersed therein while the adjacent double pick, which does not fit into this space, is temporarily raised. In the embodiment of FIG. 7, double picks 109, 110 of ballast tamping units 90 and 91 are fixedly mounted on the tamping tools so that they cannot be laterally pivoted.

As soon as machine 72 enters branch track 79 of the switch, ballast tamping units 91 and 93 with their double picks 105, 106 and 109, 110, which are indicated on the left side of FIG. 6 by short lines, are transversely adjusted until the double picks may be immersed in the ballast adjacent frogs 80. Since double picks 105 and 106 may also be laterally pivoted out of their operating positions, the increasingly narrower space between the branch and main tracks may still be worked by immersing only double picks 109, 110 in the ballast in this space. As soon as this space has become too narrow for receiving even a single double pick, the entire unit 93 is transversely adjusted by operating drive 96 until double picks 106 can be immersed in the ballast. If the tie to be tamped is obliquely positioned, drives 104 are operated to turn carrier frame 98 about vertical axis 103 until the double picks of the four ballast tamping units are centered properly with respect to the oblique tie.

Hereinabove described and illustrated machines 1 and 72 may be used universally without re-equipment to work along tangent tracks and even the most complicated switches, whatever the nature and number of track obstacles may be. The independent transverse adjustability of the four ballast tamping units permits their positioning so that the double picks may be immersed in the ballast out of the way of any obstacles encountered. The machines may equally be used in the types of tracks which have a third, center rail by transversely displacing the two ballast tamping units at the gage sides of the track rails towards the center rail. In sharp track curves, the tamping picks may also be readily adjusted to the curvature of the track by transversely adjusting the ballast tamping units in the direction of the outside of the curve.

To sum up, the universal track leveling, lining and tamping machine can be used advantageously in (a) tangent track while the machine frame advances non-stop and the operator on the machine frame works in great comfort, being shielded from the vibrations and intermittent decelerations and accelerations of the tool-carrying frame, which advantages extend at least partially to the beginning and terminal sections of a switch;

(b) tangent track while the machine advances intermittently, where it may encounter track obstacles, such as track crossings;

(c) switches while the machine advances intermittently, where it encounters track obstacles, such as guide rails, frogs and the like; and (d) in tangent track and switches while the machine advances continuously in (1) portions of the switch, (2) types of track which include a third, center rail, by displacing at least one of the ballast tamping units arranged at the gage sides of the rails towards the center rail, and (3) track curves where transverse adjustments of the ballast tamping units may be required to associate the units properly with the two track rails.

What is claimed is:

1. A universal mobile track leveling, lining and tamping machine useful for work in track switches and tangent track, the track comprising two rails fastened to ties supported on ballast and each rail having a gage side and a field side, which comprises the combination of (a) a machine frame mounted for mobility along the track in an operating direction and carrying drive, brake, operating energy source and operating control means, (b) two widely spaced undercarriages supporting the machine on the track, including a rear undercarriage in the operating direciton, (c) four ballast tamping units mounted between the undercarriages and immediately preceding the rear undercarriage in the operating direction, the ballast tamping units being mounted for independent transverse and vertical adjustment with respect to the machine frame, a respective one of the ballast tamping units being arranged at the gage side and the field side of each rail, and each ballast tamping unit comprising (1) a frame and (2) a pair of vibratory tamping tools mounted on the frame and reciprocable in the direction of the track and immersible in the ballast with a respective one of the ties positioned between the tamping tools, (d) an independent vertical guide means for independently vertically adjusting each ballast tamping unit, (e) at least one transverse guide means for independently transversely adjusting the ballast tamping units, the ballast tamping unit frames being transversely displaceably mounted on the transverse guide means, (f) a mechanical coupling for releasably connecting the frames of the tamping units at the gage and field sides of each rail for common transverse displacement thereof, (g) independent power drive means connected to each ballast tamping unit for independently vertically and transversely adjusting each unit along a respective one of the vertical guide means and the transverse guide means, (h) a track leveling and lining unit mounted on the machine between the two undercarriages and immediately preceding the ballast tamping units in the operating direction, the track leveling and lining unit comprising (1) power-driven, transversely and vertically adjustable lifting hooks and flanged lining rollers, and (i) a leveling and lining reference system controlling the track leveling and lining unit operation.

2. The universal mobile track leveling, lining and tamping machine of claim 1, wherein the transverse guide means is a common transverse guide for the four ballast tamping units and is comprised of two guide beams extending parallel to each other.

3. The universal mobile track leveling, lining and tamping machine of claim 1, wherein each ballast tamping unit comprises a vibrating drive for vibrating the tamping tools mounted on the frame, and each vibrating drive protecting laterally from a respective longitudinal side of the ballast tamping unit frame in the direction of the field side and the gage side, respectively.

4. The universal mobile track leveling, lining and tamping machine of claim 1, wherein each ballast tamping unit frame is independently vertically adjustably mounted on a respective one of the vertical guide means, the transverse guide means being comprised of two parallel guide beams at opposite ends of the ballast tamping unit frames and the frames being transversely adjustably mounted on the guide beams, each power drive means for independently transversely adjusting each unit being connected to a respective one of the ballast tamping unit frames.

* * * * *